US007635321B2

(12) United States Patent
Hill et al.

(10) Patent No.: US 7,635,321 B2
(45) Date of Patent: Dec. 22, 2009

(54) APPARATUS FOR STRETCHING AND STRENGTHENING EXTREMITIES

(75) Inventors: Sean Hill, San Diego, CA (US); Gerald Giraud, San Diego, CA (US); Bryan Hill, San Diego, CA (US)

(73) Assignee: Rehab United Sports Medicine & Physical Therapy, Inc., San Diego, CA (US)

( * ) Notice: Subject to any disclaimer, the term of this patent is extended or adjusted under 35 U.S.C. 154(b) by 132 days.

(21) Appl. No.: 11/409,282

(22) Filed: Apr. 20, 2006

(65) Prior Publication Data

US 2007/0249476 A1 Oct. 25, 2007

(51) Int. Cl.
*A63B 23/08* (2006.01)

(52) U.S. Cl. ..... 482/79; 482/907; 482/908; 482/140

(58) Field of Classification Search ..... 482/146–147, 482/23, 907–908, 140–142, 148, 79–80
See application file for complete search history.

(56) References Cited

U.S. PATENT DOCUMENTS

| | | | | |
|---|---|---|---|---|
| 1,497,243 | A | 6/1924 | Martin | |
| 2,021,801 | A | 9/1935 | Meyer | |
| 2,707,465 | A * | 5/1955 | Nemeth | 601/87 |
| 3,297,320 | A | 1/1967 | Benedetto | |
| 4,279,415 | A * | 7/1981 | Katz | 482/80 |
| 4,603,851 | A | 8/1986 | Russell | |
| 4,605,220 | A | 8/1986 | Troxel | |
| D298,266 | S | 10/1988 | Reyneke | |
| 5,304,106 | A * | 4/1994 | Gresko | 482/53 |
| D347,869 | S | 6/1994 | Friend | |
| 5,431,618 | A * | 7/1995 | Levi | 482/142 |
| 5,518,476 | A | 5/1996 | McLeon | |
| 5,807,213 | A | 9/1998 | Poncini | |
| 5,897,464 | A | 4/1999 | Mcleod | |
| 6,371,894 | B1 * | 4/2002 | Hill | 482/121 |
| 6,878,102 | B1 | 4/2005 | Commisso | |
| 2004/0023764 | A1 | 2/2004 | Repking | |
| 2004/0121888 | A1 * | 6/2004 | Williams | 482/121 |
| 2005/0014612 | A1 | 1/2005 | Sugiyama | |
| 2007/0173391 | A1 * | 7/2007 | Edwards | 482/142 |
| 2008/0214361 | A1 * | 9/2008 | Oster | 482/23 |

* cited by examiner

*Primary Examiner*—Lori Amerson
(74) *Attorney, Agent, or Firm*—Fish & Richardson P.C.

(57) ABSTRACT

An apparatus for stretching and strengthening extremities includes a foot placement foundation having an inversion plane, a neutral plane, and an eversion plane. A selectively actuatable adjustment mechanism is connected to the foot placement foundation to permit a user of the apparatus to adjust the incline of the foot placement foundation as desired.

13 Claims, 2 Drawing Sheets

APPARATUS FOR STRETCHING AND STRENGTHENING EXTREMITIES

FIELD OF THE INVENTION

The disclosed apparatus is a portable device designed for stretching and strengthening the extremities of a human user, particularly for stretching and strengthening the calf, ankle, foot and toes.

CROSS-REFERENCE TO RELATED APPLICATIONS

None

STATEMENT AS TO RIGHT TO INVENTIONS MADE UNDER FEDERAL SPONSORED RESEARCH AND DEVELOPMENT

None

DESCRIPTION OF BACKGROUND

Physical therapy is beneficial in a wide variety of circumstances, from strength training to rehabilitating injuries. The feet and calves are often the target of therapy and exercise, due to their importance in athletic activities and frequency of injury. Not surprisingly, methods and apparatus for exercising these areas have been the subject of a high degree of inventive activity, reflected in the patent literature.

For example, U.S. Pat. No. 1,497,243 to Martin is directed to a foot exerciser intended to exert upward pressure both longitudinally of the foot and transversely, and at the same time varying the direction of pressure of the weight of the body in variously changing directions, by means of a rocking platform or pedal.

U.S. Pat. No. 2,021,801 shows a foot and leg exerciser apparatus including a pair of depressible and extendible rectangular platforms. The side edges of the platforms are secured by supports with rounded bottom edges. The supports are coextensive with the outer side edges, and have there tops flush with the upper faces of the platforms.

U.S. Pat. No. 3,297,320 to Benedetto deals with a muscle exerciser apparatus including a base or housing, a foot support platform, a U-shaped bale, a front hinge pivotally connecting bale and platform adjacent the front edge of the platform, and a rear hinge pivotally connecting the rear ends of base and platform.

U.S. Pat. No. 4,603,851 to Russell describes an exercise unit for in-place exercising includes a unitary structure having a common base member with upwardly directed pads separated by a common groove, each pad terminating in an upper foot-engaging ribbed surface surrounded by a raised ledge and generally convex sidewalls and end walls which slope downwardly from the upper ribbed surfaces into the base so as to more effectively control the resistance through compression of the pads when various exercises are performed.

U.S. Pat. No. 5,807,213 to Poncini deals with a lower body exercise apparatus including a plurality of supports, each support configured to be positioned on a horizontal surface and including a base having an inclined surface. In one embodiment, the inclined surface forms an angle between approximately 20° and 55° from horizontal. In one aspect, the plurality of supports includes two supports positioned at a distance form one another and having an angle relative to one another. The user can perform exercises on the two supports to exercise the lower body and to improve agility.

U.S. Pat. No. 5,897,464 to McLeod is directed to a method and apparatus for exercising the subtalar complex with controlled triplaner motion. The principal embodiment includes a standing platform and handrail in association with a rotatable foot plate. The foot plate is controllable and adjustable in three planes with fixed settings in all planes, including the oblique. The exerciser provides a method for isolating specific muscle groups involved with foot, ankle and calf extensions or where combinations of muscles are used, such as, with dorsiflexion-eversion or plantarflexion-inversion, while preventing tibial rotation of the foot. A second embodiment provides a more portable exercise apparatus utilizing the concepts employed with the principal embodiment wherein a rocker member is provided, attached to a support member. A foot plate attaches to the support member opposite the rocker and is pivotal in the transverse and frontal planes.

U.S. Pat. No. D298,266 to Reyneke shows a foot exerciser.

U.S. Pat. No. D347,869 to Friend pictures a stretcher for heelchords and hamstrings.

SUMMARY OF INVENTION

An apparatus for stretching and strengthening extremities includes a foot placement foundation having an inversion plane, a neutral plane, and an eversion plane. A selectively actuatable adjustment mechanism is connected to the foot placement foundation to permit a user of the apparatus to adjust the incline of the foot placement foundation as desired.

The apparatus allows users to stretch and strengthen muscles in at least a neutral, inversion, and eversion plane. The apparatus features a foot platform that can be adjusted between a 15 and 20 degree incline for dorsiflexion of the foot as compared to lesser degrees of incline in similar products. The present apparatus also differs from known products in that besides targeting the calf muscle, it can be used for strengthening and stretching the ankle, including the subtalar joint, the foot, including the rear foot, mid foot, and hind foot, as well as the toes.

Although known devices provide various exercise apparatus, they are either relatively complex and difficult to use, or fail to provide a variety of needed exercise positions. It can thus be seen that the need exists for a relatively simple and easy-to-use exercise and strengthening apparatus that facilitates a wide variety of desirable exercise positions.

DESCRIPTION OF PREFERRED EMBODIMENTS

Figure 1:
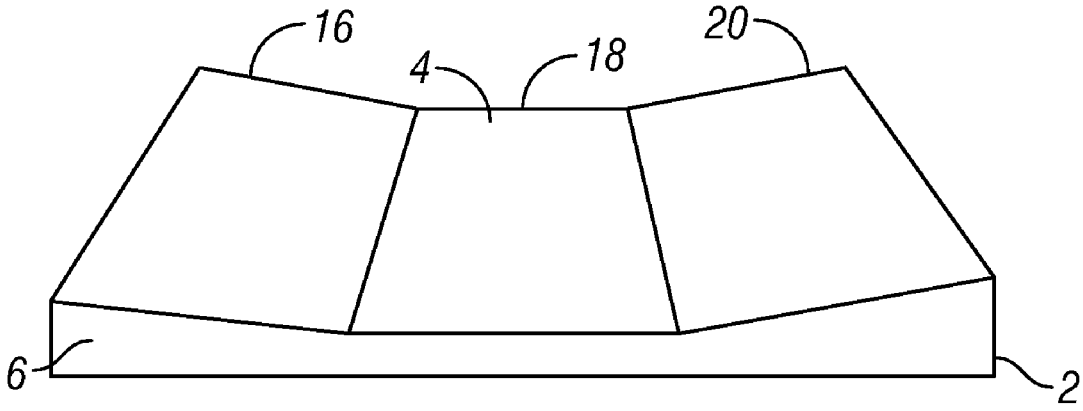
FIG. 1 is a front view of the apparatus

While the disclosed apparatus is susceptible to numerous implementations, there is shown in the drawings and herein described in further detail, exemplary implementations, with the understanding that the present disclosure is to be considered as illustrative of the principles of the apparatus and not intended to limit the invention to the exemplary embodiments shown and described.

Figure 2:
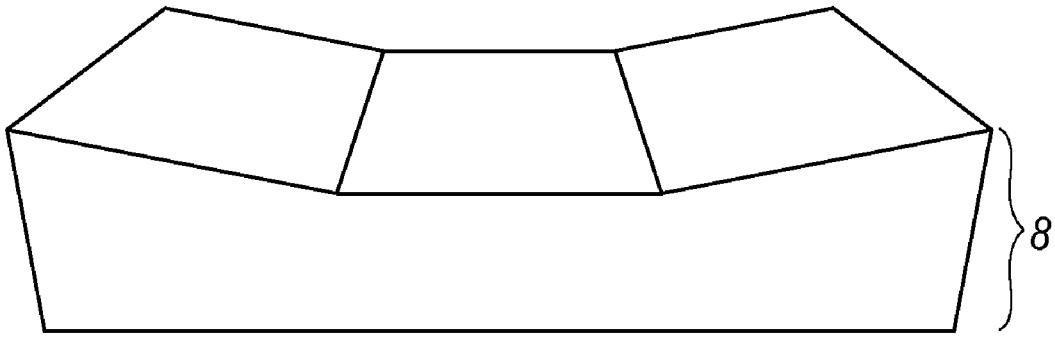
FIG. 2 is a back view of the apparatus
Figure 3:
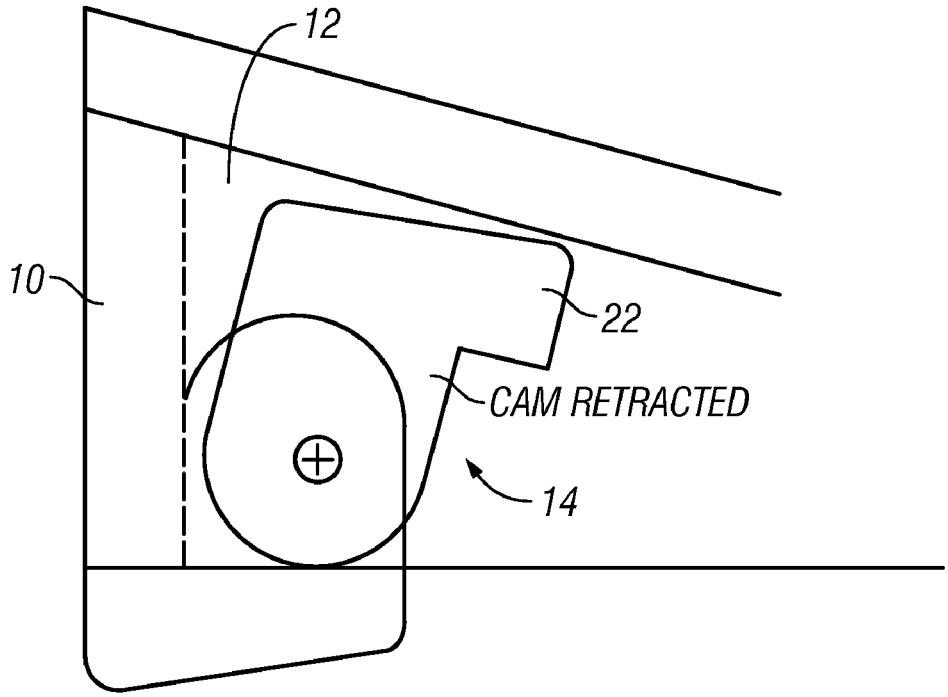
FIG. 3 is a side cut away view of the apparatus

FIGS. 1-3 respectively show the front, back, and side view of the preferred embodiment of the apparatus 2. As illustrated by these figures, the apparatus 2 is basically comprised of an adjustable foot placement foundation 4, a front panel 6, a back panel 8, two side panels 10, and an interior compartment 12 that houses a cam device 14. The bottom portions of the panels (6, 8, and 10) are generally flat so the apparatus 2 can be placed on the floor, ground, or other generally flat surface. The foot placement foundation 4 is multi-faceted to allow the user to do stretching or strengthening exercises at different angles and in different positions. The front panel 6 is shorter than the back panel 8 to create an incline in the foot placement foundation 4, which facilitates dorsiflexion of a user's foot. The two sides 10 of the apparatus 2 are accordingly wedge shaped. The cam device 14 extends between the two sides 10 within the interior compartment 12 and permits a user to adjust the incline of the foot placement foundation 4.

As illustrated by FIG. 1, the preferred embodiment of the apparatus 2 has an adjustable foot placement foundation 4 with at least three planes, including an inversion plane 16, a neutral plane 18, and an eversion plane 20. In this embodiment, the foot placement foundation 4 has an incline of 15 degrees but the incline can be increased to 20 degrees by adjusting the cam devices 14 (as is more fully explained below). The adjustable nature of the foot placement foundation 4 coupled with the different planes, 16, 18, and 20 provides a user with exponential angles at which to conduct stretching and strengthening exercises. For instance, a user can readily place either foot on the neutral plane 18 to conduct his exercises and then replace his foot on the inversion plane 16 or eversion plane 18 to conduct different exercises. Of course, the user could initially place his foot on either the inversion plane 16 or eversion plane 20 and then replace his foot on any of the other plane. Similarly, a user can place the heel (or toes) of his foot on any of the three planes (inversion 16, neutral 18, or eversion 20) and position the remainder of his foot on any other adjacent plane to conduct a different exercise. For instance, a user may place his heel (or toes) on the neutral plane 18 and position the remainder of his foot on either inversion plane 16 or eversion plane 20. By placing his heel (or toes) on one plane and the remainder of his foot on any adjacent plane, the user can conduct an exponential number of various exercises. Because the foot placement foundation 4 can be adjusted at any time to change the incline, the user can conduct a host of other exercises as well.

Although the preferred embodiment employs only three planes, other embodiments of the invention could employ fewer or more than three planes.

Figure 4:
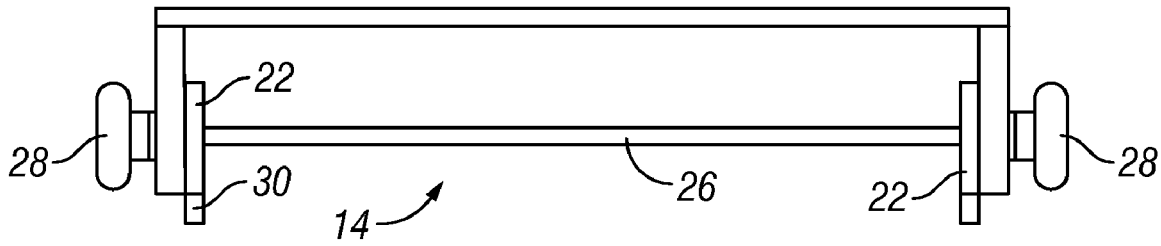
FIG. 4 is a cut away view of the front view of the apparatus and cam device

FIG. 4 more specifically illustrates the cam device 14 of the preferred embodiment which is comprised of two cams 22, a connecting shaft 26, and two handles 28. The cams 22 are connected by the connecting shaft 26 that extends beyond the interior compartment 12, while each end of the connecting shaft 26 attaches to opposite handles 28, allowing a user to adjust the cams. In particular, the cams 22 are shaped such that when they are in a neutral or retracted position, they do not affect the dorsiflexion angle of the inversion 16, neutral 18, and eversion 20 planes, i.e., these planes remain at a 15 degree incline. However, when at least one handle 28 is turned, the cams 22 are rotated and engage the ground, increasing the incline of the foot placement foundation 4 to 20 degrees. A locking device 30, such as a set screw or similar device can be employed to lock the cams 22 into the retracted or engaged positions.

In the preferred embodiment, the apparatus has specific measurements. For example, the front and back panels, 6 and 8, measure approximately 17.738 inches in length; however, the front panel 6 measures 4.375 inches in height, while the back panel measures 5.644 inches in height. This 1.269 inches in difference between the front panel 6 and back panel 8, creates an incline of at least 12 degrees. Moreover, the neutral plane 18 measures 6 inches in length, while the inversion 16 and eversion 18 planes measure approximately 5.9 inches in length. The width of all three planes 16, 18, and 20 measures 12 inches to accommodate the average foot size. Other dimensions can, of course, also be employed and the disclosed apparatus is not intended to be limited to measurement proposed for the preferred embodiment.

The apparatus can be constructed of various materials that allow it to be lightweight and durable. For instance, the foot placement foundation 4 and panels 6, 8 and 10 can be made of plastic, wood or rubber. The foot placement foundation 4 can further include a thin rubber inlay to prevent peeling at the corners and thereby promote increased durability. The bottom portions of the panels 6, 8 and 10 can also incorporate a grip surface to promote stability of the apparatus.

The invention claimed is:

1. An apparatus for stretching and strengthening extremities comprising the following:

a foot placement foundation including an inversion plane, a neutral plane, and an eversion plane; and a selectively actuatable adjustment mechanism connected to the foot placement foundation, whereby a user of the apparatus selectively actuates the adjustment mechanism to adjust the incline of the foot placement foundation;

wherein the foot placement foundation further comprises a plurality of support elements;

wherein the plurality of support elements comprise the following: a front panel; a back panel; and two side panels connecting the front panel to the back panel, the front panel, back panel, and side panels together forming an interior compartment;

wherein the adjustment mechanism is housed within the interior compartment.

2. An apparatus in accordance with claim 1, wherein the panels comprise generally flat bottom.

3. An apparatus for stretching and strengthening extremities comprising the following:

a foot placement foundation including an inversion plane, a neutral plane, and an eversion plane; and a selectively actuatable adjustment mechanism connected to the foot placement foundation, whereby a user of the apparatus selectively actuates the adjustment mechanism to adjust the incline of the foot placement foundation;

wherein the foot placement foundation further comprises a plurality of support elements;

wherein the plurality of support elements comprise the following: a front panel; a back panel; and two side panels connecting the front panel to the back panel, the front panel, back panel, and side panels together forming an interior compartment;

wherein the front panel is shorter than the back panel to create an incline in the foot placement foundation.

4. An apparatus in accordance with claim 1, wherein the side panels are generally wedge-shaped.

5. An apparatus for stretching and strengthening extremities comprising the following:

a foot placement foundation including an inversion plane, a neutral plane, and an eversion plane; and a selectively actuatable adjustment mechanism connected to the foot placement foundation, whereby a user of the apparatus selectively actuates the adjustment mechanism to adjust the incline of the foot placement foundation;

wherein the adjustment mechanism comprises a cam device.

6. An apparatus in accordance with claim 5, wherein the cam device comprises the following: a first cam; a second cam; a shaft connecting the first cam to the second cam and extending through the side panels; and at least one handle connected to the shaft outside of the interior compartment.

7. An apparatus in accordance with claim 6, wherein the at least one handle comprises a pair of handles secured to opposite ends of the connecting shaft.

8. An apparatus in accordance with claim 6, further comprising a locking device adapted and constructed to lock the cam device into a retracted position or an engaged position.

9. An apparatus in accordance with claim 8, wherein the locking device comprises a set screw.

10. An apparatus in accordance with claim 8, wherein the foot placement foundation has an incline of approximately 15 degrees from horizontal when the cam device is in a retracted position.

11. An apparatus in accordance with claim 9, wherein the foot placement foundation has an incline of up to approximately 20 degrees from horizontal when the cam device is in an engaged position.

12. An apparatus in accordance with claim 3, wherein the panels comprise generally flat bottom.

13. An apparatus in accordance with claim 3, wherein the foot placement foundation has an incline of approximately 15 degrees from horizontal.

* * * * *